US007035570B2

(12) United States Patent
Yang et al.

(10) Patent No.: US 7,035,570 B2
(45) Date of Patent: Apr. 25, 2006

(54) METHOD AND APPARATUS FOR PREVENTING TRANSFER ROLLER FROM BEING CONTAMINATED IN IMAGE FORMING SYSTEM

(75) Inventors: Cheol-ju Yang, Daegu (KR); Jun-bae Jeon, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/889,111

(22) Filed: Jul. 13, 2004

(65) Prior Publication Data

US 2005/0013630 A1 Jan. 20, 2005

Related U.S. Application Data

(63) Continuation-in-part of application No. 10/673,562, filed on Sep. 30, 2003, now abandoned.

(30) Foreign Application Priority Data

Jul. 14, 2003 (KR) ..... 2003-47718
Dec. 27, 2003 (KR) ..... 10-2003-0098229

(51) Int. Cl.
*G03G 15/00* (2006.01)
*G03G 15/16* (2006.01)

(52) U.S. Cl. ..... 399/121; 399/66; 399/389

(58) Field of Classification Search ..... 399/45, 399/66, 297, 301, 302, 313, 389
See application file for complete search history.

(56) References Cited

U.S. PATENT DOCUMENTS 5,506,660 A * 4/1996 Rabb et al. ..... 399/66
5,689,760 A * 11/1997 Suzuki et al. ..... 399/45

FOREIGN PATENT DOCUMENTS

JP 56-126874 10/1981
JP 2000-075571 3/2000

OTHER PUBLICATIONS

Notice To Submit Response; Samsung Electronics Co., Ltd.,; Application No.: 10-2003-0098229.

* cited by examiner

*Primary Examiner*—Hoang Ngo
(74) *Attorney, Agent, or Firm*—Roylance, Abrams, Berdo, Goodman, L.L.P.

(57) ABSTRACT

Provided is a method and apparatus for preventing a transfer roller from being contaminated by toner in an image forming system, the method comprising determining a size of paper based on a time when front and rear ends of the paper are detected by a paper feeding sensor; comparing a size of an image formed on a photosensitive drum with the size of the paper; and if the size of the paper is the same as or smaller than the size of the image, determining a separation time of a transfer roller from a transfer belt in consideration of a delay time when the transfer roller is mechanically separated from the transfer belt after a separation command is applied to the transfer roller.

24 Claims, 8 Drawing Sheets

METHOD AND APPARATUS FOR PREVENTING TRANSFER ROLLER FROM BEING CONTAMINATED IN IMAGE FORMING SYSTEM

PRIORITY INFORMATION

This application claims priority from Korean Patent Application Nos. 2003-47718, filed on Jul. 14, 2003 and 2003-98229, filed on Dec. 27, 2003, in the Korean Intellectual Property Office, the disclosure of which is incorporated herein by reference in its entirety. This application is a continuation-in-part of U.S. patent application Ser. No. 10/673,562, filed on Sep. 30, 2003, now abandoned, the entire contents of which are hereby incorporated by reference.

BACKGROUND OF THE INVENTION

1. Field of the Invention

The present invention relates to an image forming system, and more particularly, to a method and apparatus for preventing a transfer roller from being contaminated by toner in an image forming system when the size of paper set in a printer driver is different from the size of paper supplied from a paper feeding cassette.

2. Description of the Related Art

In an electrophotographic image forming system, when an exposure unit radiates light onto a photosensitive medium charged to a predetermined potential, an electrostatic latent image is formed on the photosensitive medium. Thereafter, a developing unit forms a toner image by supplying toner to the electrostatic latent image. In general, a color electrophotographic image forming system needs four developing units in which four color toners, such as cyan (C), magenta (M), yellow (Y), and black (B), are respectively stored. The toner image is transferred onto paper directly from the photosensitive medium or via an intermediate transfer medium. When the transferred toner image passes a fusing unit, the toner image is fused on the paper by heat and pressure. A single color or multiple color image is printed on the paper through the above procedure.

As a basic rule for the above image forming system, paper having a size appropriate for the size of an image to be formed on the photosensitive medium is supplied according to printing conditions set in a printer driver. However, in some cases, paper of an appropriate size for the size of the image cannot be supplied. When the size of the image is smaller than the size of the paper, printing problems do not occur. However, when the size of the image is larger than the size of the paper, toner corresponding to portions from the toner image formed on the photosensitive medium is transferred to a transfer roller. As a result, next sheet of paper is contaminated, or a transfer bias potential of the transfer roller is substantially reduced, causing transfer defects.

In order to solve these problems, in conventional printers, the transfer roller is cleaned by changing a polarity used during an image transfer operation and transferring toner attached onto the transfer roller on the photosensitive medium before and after a printing operation is performed on new paper. However, this added step increases the amount of time required for driving the system. As such, the life span of the system may be reduced, and an entire time required for a printing operation may increase. Additionally, when the size of paper set in the printer driver is different from the size of paper supplied from a paper feeding cassette, jamming occurs and the printing operation is stopped. As such, additional efforts and time are needed to return to a printable state. In addition, since it is determined whether the size of the paper set in the printer driver is different from the size of the paper supplied from the paper feeding cassette after a first sheet of paper has been printed, when the size of an image is larger than the size of the paper, the transfer roller is contaminated by a toner image that has been previously formed on a transfer belt.

SUMMARY OF THE INVENTION

The present invention provides a method and apparatus for preventing a transfer roller from being contaminated by toner in an image forming system when the size of paper set in a printer driver is different from the size of paper supplied from a paper feeding cassette, and an image forming system using the method and apparatus.

According to an aspect of the present invention, there is provided a method for preventing contamination of a transfer roller in an image forming system, the method comprising determining a size of paper based on a time when front and rear ends of the paper are detected by a paper feeding sensor; comparing a size of an image formed on a photosensitive drum with the size of the paper; setting a separation time of a transfer roller from a transfer belt as a first or second time period based on a time when the rear end of the paper has passed through the paper feeding sensor according to a comparison result of the size of the image and the size of the paper; and if the time when the rear end of the paper has passed through the paper feeding sensor reaches the separation time of the transfer roller, separating the transfer roller from the transfer belt.

According to another aspect of the present invention, there is provided a method for preventing contamination of a transfer roller in an image forming system, the method comprising determining a size of paper based on a time when front and rear ends of the paper are detected by a paper feeding sensor; comparing a size of an image formed on a photosensitive drum with the size of the paper; setting a separation time of a transfer roller from a transfer belt as a first or second time period based on a time when the front end of the paper has passed through the transfer roller according to a comparison result of the size of the image and the size of the paper; and if the time when the front end of the paper has passed through the transfer roller reaches the separation time of the transfer roller, separating the transfer roller from the transfer belt.

According to still another aspect of the present invention, there is provided an apparatus for preventing contamination of a transfer roller in an image forming system, the apparatus comprising a paper size determination unit for determining a size of paper based on a time when front and rear ends of the paper are detected by a paper feeding sensor; a comparison unit for comparing a size of an image formed on a photosensitive drum with the size of the paper; and a controller for determining a separation time of a transfer roller from a transfer belt in consideration of a delay time when the transfer roller is mechanically separated from the transfer belt after a separation command is applied to the transfer roller, if the size of the paper is the same as or smaller than the size of the image.

According to yet still another aspect of the present invention, there is provided a multipass color image forming system comprising a controller adapted to determine a size of paper based on a time when front and rear ends of the paper are detected by a paper feeding sensor; to compare a size of an image formed on a photosensitive drum with the size of the paper; and if the size of the paper is the same as or smaller than the size of the image, to determine a separation time of a transfer roller from a transfer belt in consideration of a delay time when the transfer roller is mechanically separated from the transfer belt after a separation command is applied to the transfer roller.

The method may be implemented using a computer readable medium on which a program for executing the method in a computer is recorded.

BRIEF DESCRIPTION OF THE DRAWINGS

The above and other aspects and advantages of the present invention will become more apparent by describing in detail preferred embodiments thereof with reference to the attached drawing figures in which.

DETAILED DESCRIPTION OF THE EXEMPLARY EMBODIMENTS

Hereinafter, exemplary embodiments of the present invention will be described in detail with reference to the accompanying drawing figures.

Figure 1:
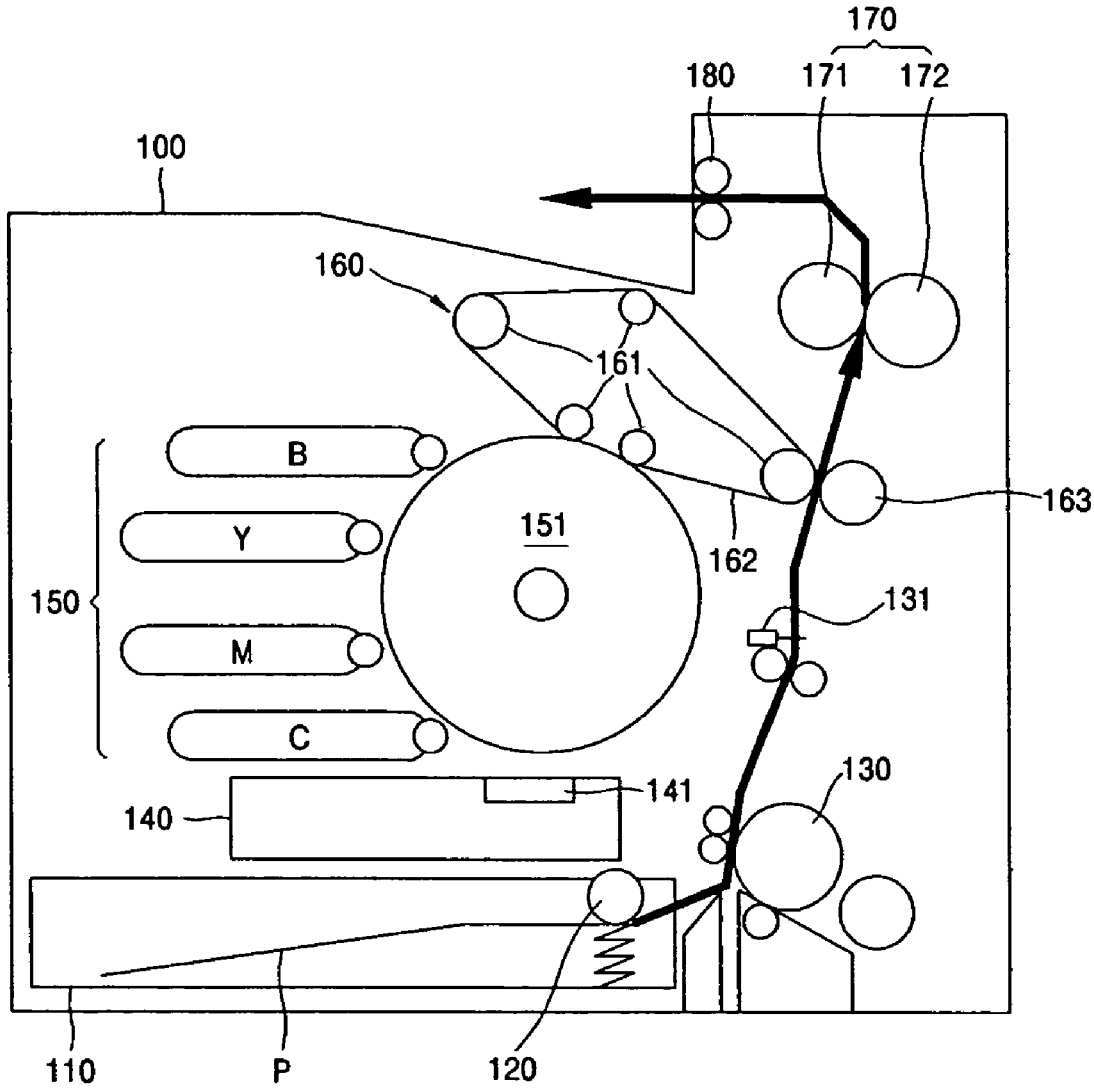
FIG. 1 is a side cross-sectional view illustrating the mechanism of an image forming system using a method for preventing a transfer roller from being contaminated, according to an embodiment of the present invention.

FIG. 1 is a side cross-sectional view illustrating the mechanism of an image forming system using a method for preventing a transfer roller from being contaminated, according to an embodiment of the present invention. The image forming system includes a stacking unit 110, a pickup unit 120, a paper feeding unit 130, an exposure unit 140, a developing unit 150, a transfer unit 160, a fusing unit 170, and a paper exhausting unit 180.

Referring to FIG. 1, the stacking unit 110, generally a paper feeding cassette, is installed in a lower portion of a main body 100, to be attached to or detached from the main body 100, and paper P is stacked therein. The paper P is picked-up by the pickup unit 120, which is rotatably installed in the main body 100, and transferred inside the main body 100 generally in the direction of the arrow.

The pickup unit 120, generally a pickup roller, picks up the paper P from the stacking unit 110. The paper feeding unit 130, generally a paper feeding roller, transfers the paper P picked-up from the stacking unit 110 inside the main body 100. A paper feeding sensor 131 detects a front or rear end of the paper P and senses whether pickup of the paper P from the stacking unit 110 has been successfully performed by the pickup unit 120 according to a detection result of the front or rear end of the paper P. In this case, the paper feeding sensor 131 is placed at a location adjacent to a transfer roller 163 but may be placed at different locations.

The exposure unit 140 radiates light corresponding to an image signal on a photosensitive drum 151 charged to have a uniform potential to form an electrostatic latent image. In general, the exposure unit 140 is a laser scanning unit (LSU) using a laser diode as a light source. In this case, a light window 141 is opposite to the photosensitive drum 151. A laser beam from the laser diode is radiated through light window 141 onto photosensitive drum 151.

The developing unit 150 comprises a plurality of ink cartridges adapted to contact the photosensitive drum 151 so as to develop the electrostatic latent image formed on the surface of the photosensitive drum 151 by the exposure unit 140, as a predetermined color image, in response to the image signal. A developing agent stored in the plurality of ink cartridges is used to form a predetermined visible image while being superimposed on the electrostatic latent image formed on the photosensitive drum 151. A method of forming a color image by repeatedly performing exposure, development, and transfer operations for each color using an exposure unit 140 and a photosensitive drum 151 is referred to as a multipass method.

The transfer unit 160 includes a transfer belt 162, which is supported by a plurality of transfer belt backup rollers 161 and rotated in a closed loop and on which the toner image formed on the surface of the photosensitive drum 151 is transferred. The transfer unit 160 further includes a transfer roller 163, which is installed to be opposite to one of the plurality of transfer belt backup rollers 161. The transfer belt 162 is placed between the plurality of transfer belt backup rollers 161 and the transfer roller 163, and presses the paper P toward the transfer belt 162. Thus, a color toner image transferred from the photosensitive drum 151 to the transfer belt 162 is transferred onto the paper P. The traveling linear velocity of the transfer belt 162 is preferably the same as a rotation linear velocity of the photosensitive drum 151. In addition, the length of the transfer belt 162 is preferably the same as or longer than the length of the paper P in which the color toner image is finally received.

In the transfer unit 160, the transfer roller 163 is installed to be opposite to the transfer belt 162. The transfer roller 163 is separated from the transfer belt 162 by a solenoid (not shown) while the color toner image is transferred to the transfer belt 162. When the color toner image is completely transferred to the transfer belt 162, the transfer roller 163 contacts the transfer belt 162 at a predetermined pressure, so as to transfer the color toner image onto the paper P.

The fusing unit 170 includes a fusing roller 171 which generates heat, and a pressing roller 172 which is installed opposite the fusing roller 171. The paper P is placed between the fusing roller 171 and the pressing roller 172, and presses the paper P toward the fusing roller 171. The fusing roller 171 applies heat to the paper P in which the visible image is formed, and fuses the visible image onto the paper P.

The paper exhausting unit 180, generally a paper exhausting roller, exhausts the paper P in which the visible image is formed to outside. In order to perform printing on both sides, the paper exhausting unit 180 is reversed. As such, the paper P is reversely rotated and transferred to a reversal path.

Figure 2:
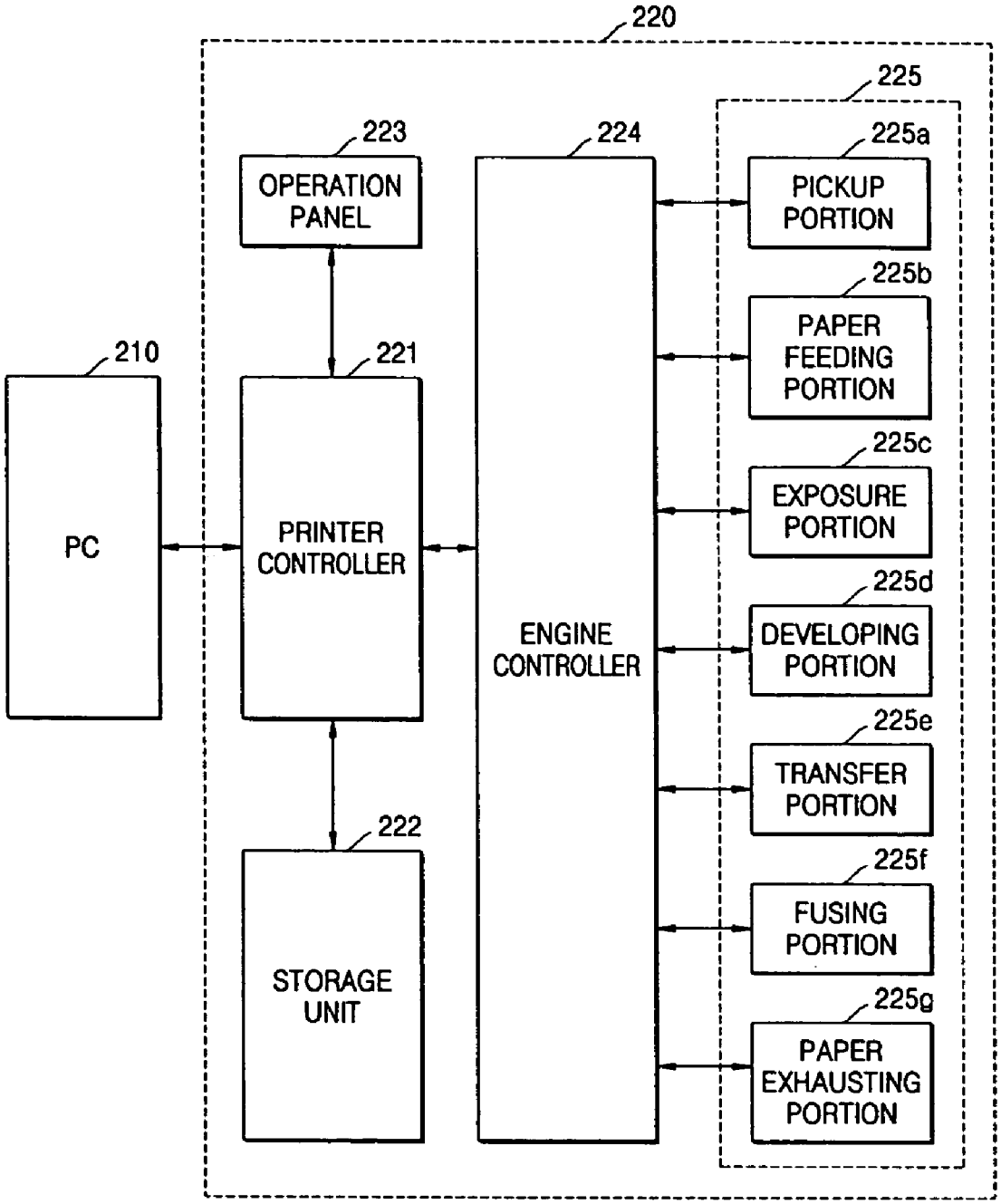
FIG. 2 is a functional block diagram illustrating a function of the image forming system for performing the method for preventing a transfer roller from being contaminated, according to an embodiment of the present invention.

FIG. 2 is a functional block diagram illustrating a function of an image forming system 220 for performing the method for preventing a transfer roller from being contaminated. The image forming system 220 includes a printer controller 221, a storage unit 222, an operation panel 223, an engine controller 224, and an engine unit 225.

Referring to FIG. 2, the printer controller 221 converts a printing data received from outside, e.g., from a computer (PC) 210 connected to a communication interface, into an image data appropriate for driving the engine unit 225 according to printing conditions set in a printer driver (not shown) and stores the image data in the storage unit 222.

The storage unit 222 stores various control programs required to implement the function of the image forming system 220, various data generated in the printer controller 221 by performing the control programs, the printing data received from the PC 210, and printing information temporarily.

The operation panel 223 includes a key matrix and a display. The key matrix generates data according to keys pressed by a user to designate each mode and to perform an operation in a designated mode, and outputs the data to the printer controller 221. The display displays the operational state of the system when the printer controller 221 executes each mode.

The engine controller 224 controls the engine unit 225 so that an image corresponding to the image data received from the printer controller 221 is printed on the paper P. For this purpose, when a printing instruction command is received from the printer controller 221, the engine controller 224 controls the engine unit 225 so that each of portions 225*a*–225*g* of the engine unit 225 is prepared to perform a printing operation. An example of printing operation preparation is to rotate a polygonal rotating mirror or a scan disc, which is a deflection unit of an exposure portion 225*c*, at a predetermined speed required during the printing operation, or to heat a fusing portion 225*f* to a predetermined temperature, or to check whether something is wrong with each device that performs the printing operation.

Thus, after the printing instruction command has been received from the printer controller 221, when it is determined that the printing operation can be performed after a printing preparation time, the engine controller 224 controls the engine unit 225 to apply a printing starting signal to the printer controller 221 and to supply an image data stored in the storage unit 222 to the exposure portion 225*c* via the engine controller 224.

The engine unit 225 includes various portions required for the printing operation. For example, in the case of electrophotographic image forming system, the engine unit 225 includes a pickup portion 225*a*, a paper feeding portion 225*b*, an exposure portion 225*c*, a developing portion 225*d*, a transfer portion 225*e*, a fusing portion 225*f*, and a paper exhausting portion 225*g*, as shown in FIG. 2. In this way, the engine unit 225 may be formed in various shapes according to a printing method.

Figure 3:
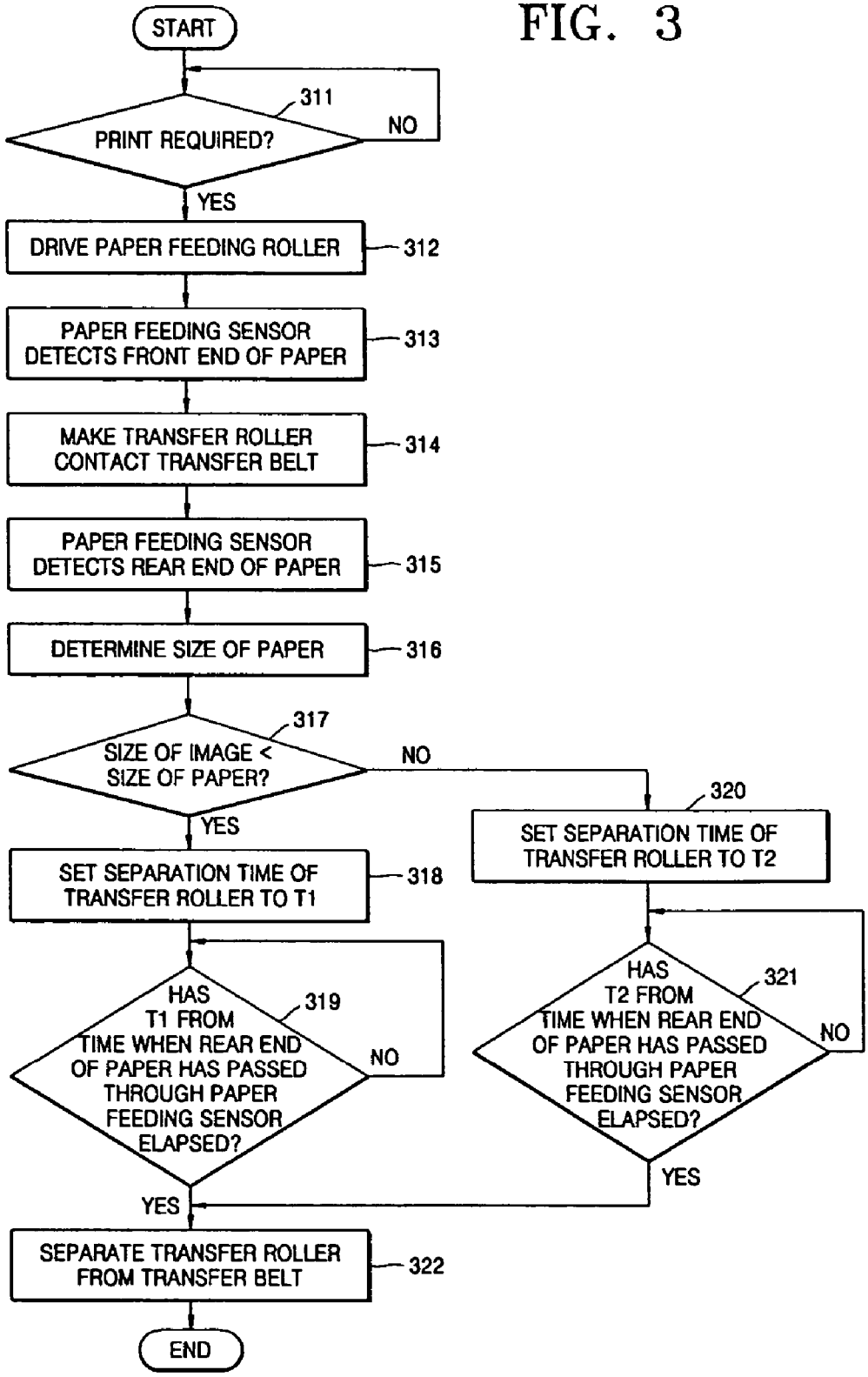
FIG. 3 is a flowchart illustrating a method for preventing a transfer roller from being contaminated in an image forming system, according to an embodiment of the present invention.

FIG. 3 is a flowchart illustrating a method for preventing a transfer roller from being contaminated, according to an embodiment of the present invention. The method for preventing a transfer roller from being contaminated comprises determining the size of paper of a paper feeding cassette (operations 311 through 316), setting a separation time of the transfer roller 163 according to a comparison result of the size of the paper of the paper feeding cassette and the size of an image (operations 317, 318, and 320), and separating the transfer roller 163 from the transfer belt 162 when the separation time of the transfer roller 163 has elapsed (operations 319, 321, and 322). Preferably, each of the operations is programmed as code segments performed in the printer controller 221 or an additional processor and will be described with reference to FIGS. 1 and 2.

Referring to FIG. 3, in operation 311, it is monitored whether a print command is given from the PC 210. When the print command is given, in operation 312, the paper feeding unit 130 such as a paper feeding roller, is driven, and in operation 313, a front end of paper is detected by the paper feeding sensor 131. When a color toner image is completely transferred to the transfer belt 162 from the photosensitive drum 151, in operation 314, the transfer roller 163 contacts the transfer belt 162 at a predetermined pressure, so as to transfer the color toner image onto the paper P. In operation 315, a rear end of paper is detected by the paper feeding sensor 131. In operation 316, the size of the paper picked-up from the stacking unit 110 is determined using the time when the front end of the paper is detected by the paper feeding sensor 131 and the time when the rear end of the paper is detected by the paper feeding sensor 131. In general, the size of the paper is determined by the length in a paper transfer direction, but the length cannot be directly measured. Thus, the paper feeding sensor 131 is placed at a location adjacent to the paper feeding unit 130 such as the paper feeding roller, on a transfer path of the paper or at a location adjacent to the transfer roller 163. When the front end of the paper is detected by the paper feeding sensor 131, a timer starts operating, and when the rear end of the paper is detected by the paper feeding sensor 131, the timer stops operating. In this way, the length in the paper transfer direction (that is, the length of the paper in a secondary scanning direction) is determined by a detection time when the front and rear ends of the paper are detected by the paper feeding sensor 131. After the length in the paper transfer direction is determined, the width (that is, the length of the paper in a primary scanning direction) may be determined based on the standard size of the paper.

In operation 317, the size of driver paper is compared with the size of the paper stacked in the paper feeding cassette determined in operation 316. In this case, the size of the driver paper, i.e., the size of an image formed on the photosensitive drum 151, is provided in advance from the PC 210.

As a comparison result of operation 317, when the size of the driver paper, i.e., the size of the image formed on the photosensitive drum 151, is smaller than the size of the paper stacked in the paper feeding cassette, in operation 318, the separation time of the transfer roller 163 is set to a first predetermined time T1. The first predetermined time T1 is set to a time period from a time when the rear end of the paper has passed through the paper feeding sensor 131 to a time when the rear end of the paper reaches a nip of the transfer roller 163. The first predetermined time T1 may be different according to a distance between the paper feeding sensor 131 and the nip of the transfer roller 163 and a printing speed. The first predetermined time T1 is preferably stored in advance in a database by the size of paper according to the type of an image forming apparatus.

Meanwhile, as a comparison result of operation 317, when the size of the driver paper (the size of the image formed on the photosensitive drum 151) is the same as or larger than the size of the paper stacked in the paper feeding cassette, in operation 320, the separation time of the transfer roller 163 is set to a second predetermined time T2. In this case, the second predetermined time T2 is smaller than the first predetermined time T1 and is determined according to a distance between the paper feeding sensor 131 and the nip of the transfer roller 163 and a printing speed and in consideration of a delay time $T_d$ when the transfer roller 163 is mechanically separated from the transfer belt 162 after a separation command is given from the engine controller 224. Additionally, a safety factor, that is, a mechanical tolerance α, may be further considered in the determination of the second predetermined time T2. In this case, the second predetermined time T2 is given by Equation 1.

$$T2=T1-\alpha T_d \quad (1)$$

By setting the second predetermined time T2 as above, the transfer roller 163 is prevented from being contaminated by an image longer than the size of the paper stacked in the paper feeding cassette and transferred to the transfer belt 162.

In operation 319, when the size of the image formed on the photosensitive drum 151 is smaller than the size of the paper stacked in the paper feeding cassette, it is determined whether the first predetermined time T1 has elapsed from a time when the rear end of the paper has passed through the paper feeding sensor 131. As a determination result of operation 319, when the first predetermined time T1 has elapsed, in operation 322, the transfer roller 163 is separated from the transfer belt 162. Meanwhile, in operation 321, when the size of the image formed on the photosensitive drum 151 is the same as or larger than the size of the paper stacked in the paper feeding cassette, it is determined whether the second predetermined time T2 has elapsed from the time when the rear end of the paper has passed through the paper feeding sensor 131. As a determination result of operation 321, when the second predetermined time T2 has elapsed, in operation 322, the transfer roller 163 is separated from the transfer belt 162.

After operation 322, the paper is normally exhausted through the fusing unit 170 and the paper exhausting unit 180, and the printing operation is terminated.

The above-described method is applied to an embodiment in which a transfer operation has been already performed on the transfer belt 161 from the photosensitive drum 151 at a time when the size of the paper stacked in the paper feeding cassette is determined. However, the method may be applied to an embodiment in which the transfer operation has not yet been performed on the transfer belt 161 from the photosensitive drum 151 at the time when the size of the paper stacked in the paper feeding cassette is determined. In addition, the method may be applied to a multipass color image forming apparatus for forming a complete image by superimposing each color image on a medium such as an intermediate transfer belt after outputting all of color video data.

Figure 4:
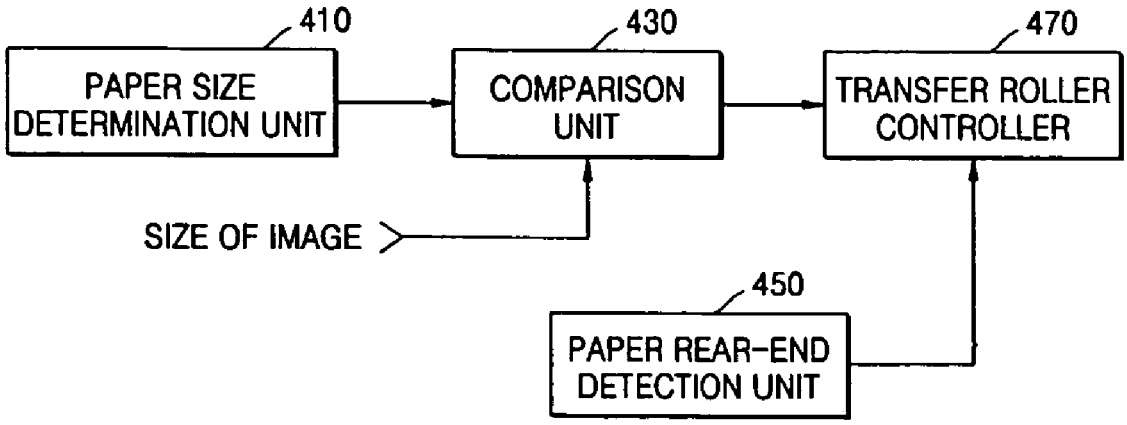
FIG. 4 is a block diagram illustrating a structure of an apparatus for preventing a transfer roller from being contaminated in an image forming system, according to an embodiment of the present invention.

FIG. 4 is a block diagram illustrating a structure of an apparatus for preventing a transfer roller from being contaminated, according to an embodiment of the present invention. The apparatus for preventing a transfer roller from being contaminated includes a paper size determination unit 410, a comparison unit 430, a paper rear-end detection unit 450, and a transfer roller controller 470.

Referring to FIG. 4, the paper size determination unit 410 determines the size of paper from a time when front and rear ends of the paper picked-up from a paper feeding cassette are detected by the paper feeding sensor 131.

The comparison unit 430 compares the size of the paper determined by the paper size determination unit 410 with the size of an image which is information supplied from a personal computer (PC) from which a print command is given, and supplies a signal generated according to a comparison result to the transfer roller controller 470. The paper rear-end detection unit 450 supplies a time when the rear end of the paper is detected by the paper feeding sensor 131 to the transfer roller controller 470.

The transfer roller controller 470 stores in advance a first predetermined time T1 as a separation time of the transfer roller 163 from the transfer belt 162 when the size of an image formed on the photosensitive drum 151 is smaller than the size of the paper stacked in the paper feeding cassette and a second predetermined time T2 as the separation time of the transfer roller 163 from the transfer belt 162 when the size of the image formed on the photosensitive drum 151 is the same as or larger than the size of the paper stacked in the paper feeding cassette. When the size of the image is smaller than the size of the paper, the transfer roller controller 470 determines whether the first predetermined time T1 has elapsed from a time when the rear end of the paper has passed through the paper feeding sensor 131. When the first predetermined time T1 has elapsed, the transfer roller controller 470 applies a command to separate the transfer roller 163 from the transfer belt 162 to the engine controller 224. Meanwhile, when the size of the image is the same as or larger than the size of the paper, the transfer roller controller 470 determines whether the second predetermined time T2 has elapsed from the time when the rear end of the paper has passed through the paper feeding sensor 131. When the second predetermined time T2 has elapsed, the transfer roller controller 470 applies the command to separate the transfer roller 163 from the transfer roller 162 to the engine controller 224.

Figure 5:
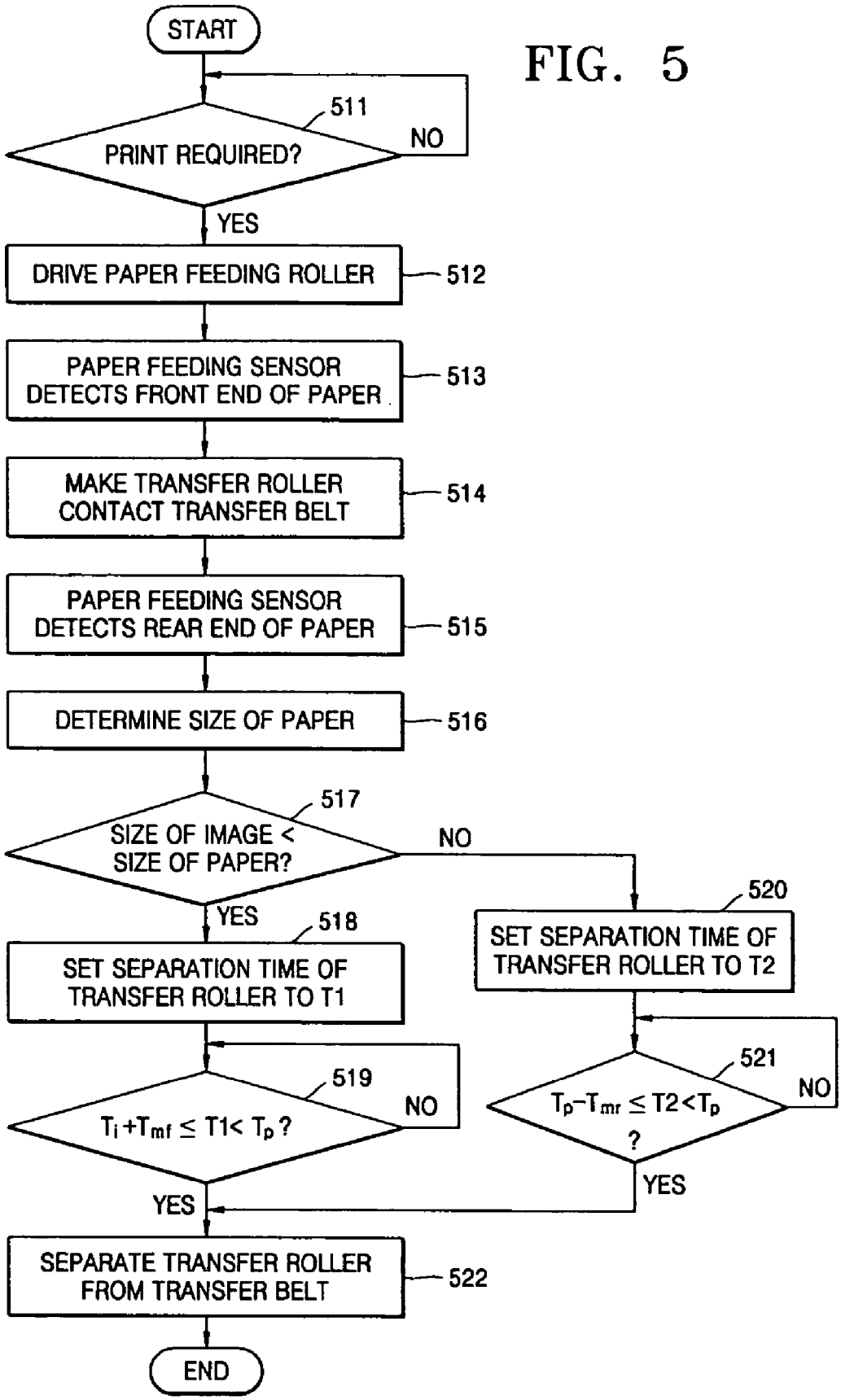
FIG. 5 is a flowchart illustrating a method for preventing a transfer roller from being contaminated, according to another embodiment of the present invention.

FIG. 5 is a flowchart illustrating a method for preventing a transfer roller from being contaminated, according to another embodiment of the present invention. The method for preventing a transfer roller from being contaminated comprises determining the size of paper of a paper feeding cassette (operations 511 through 516), setting a separation time of the transfer roller 163 according to a comparison between the size of the paper of the paper feeding cassette and the size of an image (operations 517, 518, and 520), and separating the transfer roller 163 from the transfer belt 162 when the separation time of the transfer roller 163 has elapsed (operations 519, 521, and 522). The method can be applied to embodiments of the present invention regardless of the location of the paper feeding sensor 131. Only portions different from the embodiment shown in FIG. 3 will be described with reference to FIGS. 6A, 6B, 7A, and 7B.

Figure 6A:
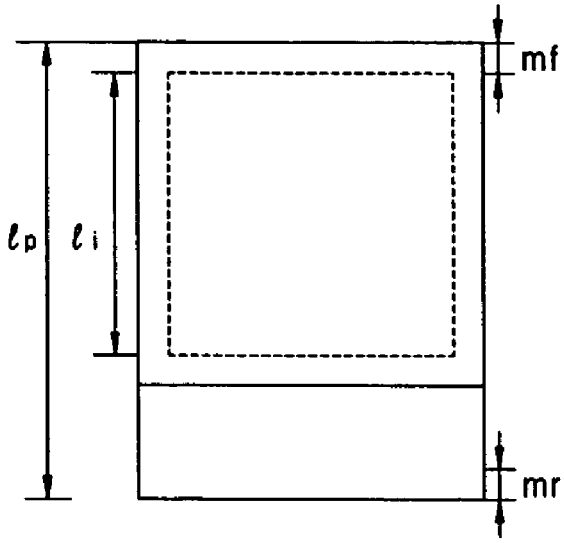
FIGS. 6A and 6B show a transfer roller separation mechanism when the size of paper is larger than the size of an image.
Figure 6B:
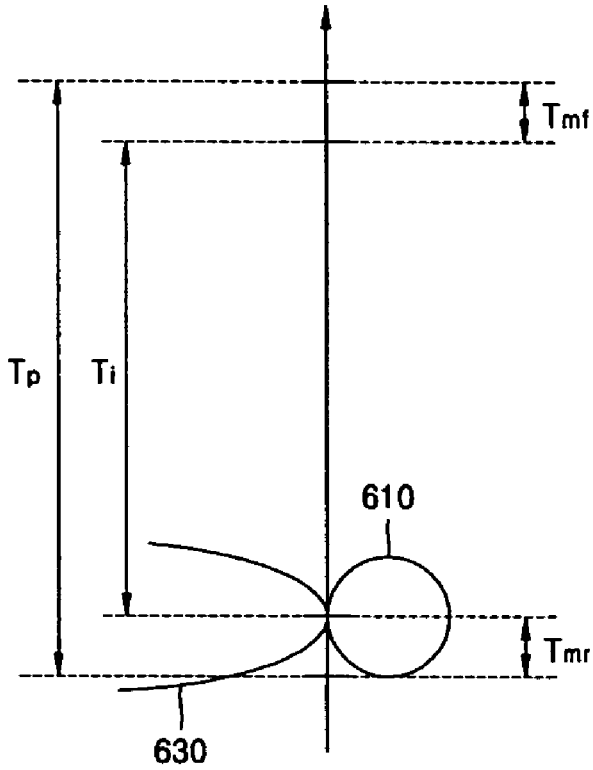
Figure 7A:
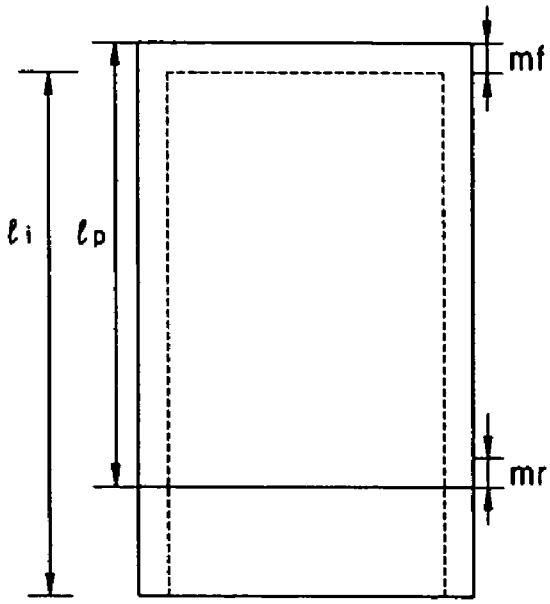
FIGS. 7A and 7B show the transfer roller separation mechanism when the size of the image is larger than the size of the paper.
Figure 7B:
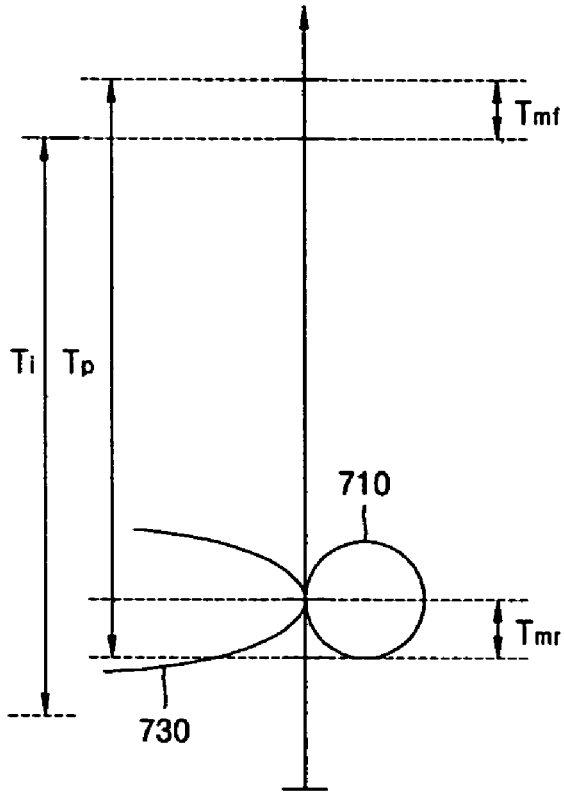

FIGS. 6A and 6B show a transfer roller separation mechanism when the size of paper is larger than the size of an image, and FIGS. 7A and 7B show the transfer roller separation mechanism when the size of the image is larger than the size of the paper. In FIGS. 6A and 7A, $l_p$ is the length of the paper, $l_i$ is the length of the image, mf is an upper end page margin, and mr is a lower end page margin. In FIGS. 6B and 7B, $T_p$ is a time taken for transferring the paper having the length of $l_p$, $T_i$ is a time taken for printing the image having the length of $l_i$, $T_{mf}$ is a time taken for obtaining the upper end page margin mf, and $T_{mr}$ is a time taken for obtaining the lower end page margin mr.

Referring back to FIG. 5, as a comparison result of operation 517, when the size of driver paper, i.e., the size of the image formed on the photosensitive drum 151, is smaller than the size of the paper stacked in the paper feeding cassette, in operation 518, the separation time of the transfer roller 163 is set to a first predetermined time T1. The first predetermined time T1 may be stored in advance in a database by the size of paper according to the type of an image forming apparatus and is given by Equation 2.

$$T_i+T_{mf}\leq T1<T_p \quad (2)$$

$T_p$ is a time taken for transferring the paper having the length of $l_p$, $T_i$ is a time taken for printing the image having the length of $l_i$, and $T_{mf}$ is a time taken for obtaining the upper end page margin mf. In this case, since the length $l_i$ of the image is the same as or smaller than the length ($l_p$-mr) obtained by subtracting the lower end pape margin mr from the length $l_p$ of the paper, the transfer roller 163 is not contaminated by toner without considering a delay time $T_d$ when the transfer roller 163 is mechanically separated from the transfer belt 162 after a separation command is given from the engine controller 224.

Meanwhile, as a comparison result of operation 517, when the size of the driver paper, i.e., the size of the image formed on the photosensitive drum 151, is the same as or larger than the size of the paper stacked in the paper feeding cassette, in operation 520, the separation time of the transfer roller 163 is set to a second predetermined time T2. The second predetermined time T2 may be stored in advance in the database by the size of paper according to the type of an image forming apparatus and is given by Equation 3.

$$T_p-T_{mr}\leq T2<T_p \quad (3)$$

$T_p$ is a time taken for transferring the paper having the length of $l_p$, and $T_{mr}$ is a time taken for obtaining the upper end page margin mr.

Preferably, the delay time $T_d$ when the transfer roller 163 is mechanically separated from the transfer belt 162 after a separation command is given from the engine controller 224 is considered, and a safety factor, that is, a mechanical tolerance a, may be further considered in the determination of the second predetermined time T2. In this case, the second predetermined time T2 is given by Equation 4.

$$T_p-T_{mr}-\alpha T_d\leq T2<T_p-\alpha T_d \quad (4)$$

By setting the second predetermined time T2 as above, the transfer roller 163 is prevented from being contaminated by an image longer than the size of the paper stacked in the paper feeding cassette and transferred to the transfer belt 162.

In operation 519, when the size of the image formed on the photosensitive drum 151 is smaller than the size of the paper stacked in the paper feeding cassette, it is determined whether the counted time from a time when the front end of the paper has passed through the transfer roller 163 falls within the first predetermined time T1. As a determination result of operation 519, when the counted time falls within the first predetermined time T1, in operation 522, a command to separate the transfer roller 163 from the transfer belt 162 is applied to the engine controller 224. Meanwhile, in operation 521, when the size of the image formed on the photosensitive drum 151 is the same as or larger than the size of the paper stacked in the paper feeding cassette, it is determined whether the counted time from the time when the front end of the paper has passed through the transfer roller 163 falls within the second predetermined time T2. As a determination result of operation 521, when the counted time falls within the second predetermined time T2, in operation 522, the command to separate the transfer roller 163 from the transfer belt 162 is applied to the engine controller 224.

Figure 8:
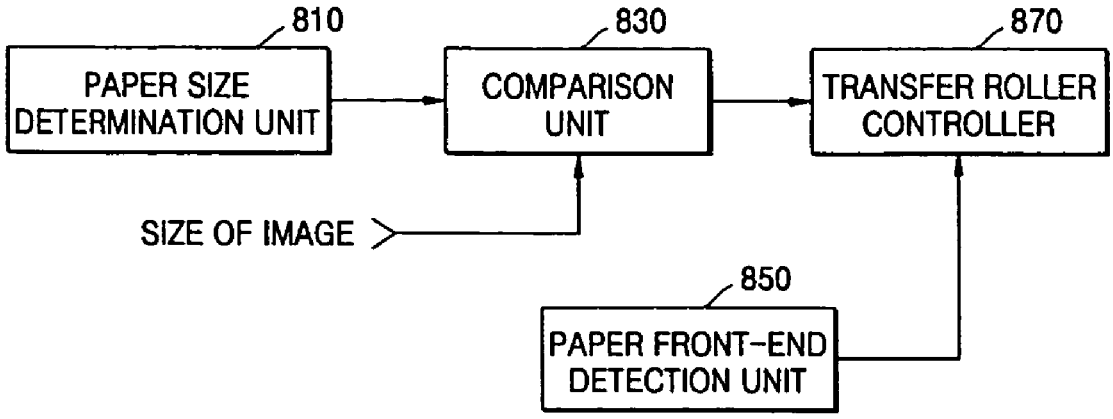
FIG. 8 is a block diagram illustrating a structure of an apparatus for preventing a transfer roller from being contaminated, according to another embodiment of the present invention. In the drawing figures, it will be understood that like numerals refer to like features and structures.

FIG. 8 is a block diagram illustrating a structure of an apparatus for preventing a transfer roller from being contaminated, according to another embodiment of the present invention. The apparatus for preventing a transfer roller from being contaminated includes a paper size determination unit 810, a comparison unit 830, a paper front-end detection unit 850, and a transfer roller controller 870.

Referring to FIG. 8, the paper size determination unit 810 determines the size of paper from a time when front and rear ends of the paper picked-up from a paper feeding cassette are detected by the paper feeding sensor 131.

The comparison unit 830 compares the size of the paper determined by the paper size determination unit 810 with the size of an image which is information supplied from a personal computer (PC) from which a print command is given, and supplies a signal generated according to a comparison result to the transfer roller controller 870. The paper front-end detection unit 850 supplies a time when the front end of the paper is detected by a nip of the transfer roller 163 to the transfer roller controller 870.

The transfer roller controller 870 stores in advance a first predetermined time T1 as a separation time of the transfer roller 163 from the transfer belt 162 when the size of an image formed on the photosensitive drum 151 is smaller than the size of the paper stacked in the paper feeding cassette and a second predetermined time T2 as the separation time of the transfer roller 163 from the transfer belt 162 when the size of the image formed on the photosensitive drum 151 is the same as or larger than the size of the paper stacked in the paper feeding cassette. When the size of the image is smaller than the size of the paper, the transfer roller controller 870 determines whether the counted time from a time when the front end of the paper has passed through the nip of the transfer roller 163 falls within the first predetermined time T1. When the counted time falls within the first predetermined time T1, the transfer roller controller 870 applies a command to separate the transfer roller 163 from the transfer belt 162 to the engine controller 224. Meanwhile, when the size of the image is the same as or larger than the size of the paper, the transfer roller controller 870 determines whether the counted time from the time when the front end of the paper has passed through the nip of the transfer roller 163 falls within the second predetermined time T2. When the counted time falls within the second predetermined time T2, the transfer roller controller 870 applies the command to separate the transfer roller 163 from the transfer roller 162 to the engine controller 224.

The invention can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Also, functional programs, codes, and code segments for accomplishing the present invention can be easily construed by programmers skilled in the art to which the present invention pertains.

As described above, embodiments of the present invention are applied to the structure of a multipass color image forming apparatus without a paper size sensor, and when the size of paper set in a printer driver (the size of an image formed on a photosensitive drum) is larger than the size of paper stacked in a paper feeding cassette, a transfer roller is separated from a transfer belt before the transfer roller is contaminated by toner, such that the transfer roller is prevented from being contaminated by toner.

While the present invention has been particularly shown and described with reference to exemplary embodiment thereof, it will be understood by those of ordinary skill in the art that various changes in form and details may be made therein without departing from the spirit and scope of the invention as defined by the following claims.

What is claimed is:

1. A method for preventing contamination of a transfer roller in an image forming system, the method comprising:

determining a size of paper based on a time when front and rear ends of the paper are detected by a paper feeding sensor;

comparing a size of an image formed on a photosensitive drum with the size of the paper; and if the size of the paper is the same as or smaller than the size of the image, determining a separation time of a transfer roller from a transfer belt in consideration of a delay time when the transfer roller is mechanically separated from the transfer belt after a separation command is applied to the transfer roller.

2. The method of claim 1, wherein the separation time of the transfer roller is determined by further considering a mechanical tolerance.

3. A method for preventing contamination of a transfer roller in an image forming system, the method comprising:

determining a size of paper based on a time when front and rear ends of the paper are detected by a paper feeding sensor;

comparing a size of an image formed on a photosensitive drum with the size of the paper;

setting a separation time of a transfer roller from a transfer belt as a first or second time period based on a time when the rear end of the paper has passed through the paper feeding sensor according to a comparison between the size of the image and the size of the paper; and if the time when the rear end of the paper has passed through the paper feeding sensor reaches the separation time of the transfer roller, separating the transfer roller from the transfer belt.

4. The method of claim 3, wherein the first time period is set when the size of the paper is larger than the size of the image and according to a distance between the paper feeding sensor and the transfer roller and a printing speed.

5. The method of claim 3, wherein the second time period is set when the size of the paper is the same as or smaller than the size of the image and according to a distance between the paper feeding sensor and the transfer roller and a printing speed and in consideration of a delay time when the transfer roller is mechanically separated from the transfer belt after a separation command is applied to the transfer roller.

6. The method of claim 5, wherein the second time period is determined by further considering a mechanical tolerance.

7. A method for preventing contamination of a transfer roller in an image forming system, the method comprising:

determining a size of paper based on a time when front and rear ends of the paper are detected by a paper feeding sensor;

comparing a size of an image formed on a photosensitive drum with the size of the paper;

setting a separation time of a transfer roller from a transfer belt as a first or second time period based on a time when the front end of the paper has passed through the transfer roller according to a comparison result of the size of the image and the size of the paper; and if the time when the front end of the paper has passed through the transfer roller reaches the separation time of the transfer roller, separating the transfer roller from the transfer belt.

8. The method of claim 7, wherein the first time period T1 is set when the size of the paper is larger than the size of the image and is given by:

$$T_i+T_{mf}\leqq T1<T_p$$

where $T_p$ is a time taken for transferring the paper having the length of $l_p$, $T_i$ is a time taken for printing the image having the length of $l_i$, and $T_{mf}$ is a time taken for obtaining an upper end page margin.

9. The method of claim 7, wherein the second time period T2 is set when the size of the paper is the same as or smaller than the size of the image and is given by:

$$T_p-T_{mr}\leqq T2<T_p$$

where $T_p$ is a time taken for transferring the paper having the length of $l_p$, and $T_{mr}$ is a time taken for obtaining a lower upper end page margin.

10. The method of claim 7, wherein the second time period T2 is set when the size of the paper is the same as or smaller than the size of the image and is given by:

$$T_p-T_{mr}-\alpha T_d\leqq T2<T_p-\alpha T_d$$

where $T_p$ is a time taken for transferring the paper having the length of $l_p$, $T_{mr}$ is a time taken for obtaining a lower end page margin, $T_d$ is a delay time when the transfer roller is mechanically separated from the transfer belt after a separation command is applied to the transfer roller, and $\alpha$ is a mechanical tolerance.

11. The method of claim 1, wherein the method is applied to a structure of a multipass color image forming apparatus.

12. The method of claim 3, wherein the method is applied to a structure of a multipass color image forming apparatus.

13. The method of claim 7, wherein the method is applied to a structure of a multipass color image forming apparatus.

14. A computer readable recording medium of instructions adapted to control an image forming system to prevent contamination of a transfer roller comprising:

a first set of instructions adapted to control the system to determine a size of paper based on a time when front and rear ends of the paper are detected by a paper feeding sensor;

a second set of instructions adapted to control the system to compare a size of an image formed on a photosensitive drum with the size of the paper; and a third set of instructions adapted to control the system to determine a separation time of a transfer roller from a transfer belt in consideration of a delay time when the transfer roller is mechanically separated from the transfer belt after a separation command is applied to the transfer roller, if the size of the paper is the same as or smaller than the size of the image.

15. An apparatus for preventing contamination of a transfer roller in an image forming system, the apparatus comprising:

a paper size determination unit for determining a size of paper based on a time when front and rear ends of the paper are detected by a paper feeding sensor;

a comparison unit for comparing a size of an image formed on a photosensitive drum with the size of the paper; and a controller for determining a separation time of a transfer roller from a transfer belt in consideration of a delay time when the transfer roller is mechanically separated from the transfer belt after a separation command is applied to the transfer roller, if the size of the paper is the same as or smaller than the size of the image.

16. The apparatus of claim 15, wherein the controller comprises:

a paper rear-end for detection unit detecting a time when the rear end of the paper has passed through the paper feeding sensor; and a transfer roller controller for setting a separation time of a transfer roller from a transfer belt as a first or second time period based on a time when the rear end of the paper has passed through the paper feeding sensor according to a comparison result of the comparison unit and if the time when the rear end of the paper has passed through the paper feeding sensor reaches the separation time of the transfer roller, separating the transfer roller from the transfer belt.

17. The apparatus of claim 15, wherein the controller comprises:

a paper front-end detection unit for detecting a time when the front end of the paper has passed through the paper feeding sensor; and a transfer roller controller for setting a separation time of a transfer roller from a transfer belt as a first or second time period based on a time when the front end of the paper has passed through the transfer roller according to a comparison result of the comparison unit and if the time when the front end of the paper has passed through the transfer roller reaches the separation time of the transfer roller, separating the transfer roller from the transfer belt.

18. The apparatus of claim 16, wherein the first time period is set when the size of the paper is larger than the size of the image and according to a distance between the paper feeding sensor and the transfer roller and a printing speed.

19. The apparatus of claim 16, wherein the second time period is set when the size of the paper is the same as or smaller than the size of the image and according to a distance between the paper feeding sensor and the transfer roller and a printing speed and in consideration of a delay time when the transfer roller is mechanically separated from the transfer belt after a separation command is applied to the transfer roller.

20. The apparatus of claim 17, wherein the first time period is set when the size of the paper is larger than the size of the image and according to a length of the paper, a length of the image, a length of an upper end page margin, and a printing speed.

21. The apparatus of claim 17, wherein the second time period is set when the size of the paper is the same as or smaller than the size of the image and according to the length of the paper, a length of a lower end page margin, and a printing speed.

22. The apparatus of claim 21, wherein the second time period is determined in consideration of the delay time when the transfer roller is mechanically separated from the transfer belt after the separation command is applied to the transfer roller.

23. The apparatus of claim 15, wherein the image forming system is implemented by a structure of a multipass color image forming apparatus.

24. A multipass color image forming system comprising a controller adapted to perform the following operations:

determining a size of paper based on a time when front and rear ends of the paper are detected by a paper feeding sensor;

comparing a size of an image formed on a photosensitive drum with the size of the paper; and if the size of the paper is the same as or smaller than the size of the image, determining a separation time of a transfer roller from a transfer belt in consideration of a delay time when the transfer roller is mechanically separated from the transfer belt after a separation command is applied to the transfer roller.

* * * * *